US005427524A

United States Patent [19]

Lazalier

[11] Patent Number: 5,427,524

[45] Date of Patent: Jun. 27, 1995

[54] NATURAL GAS FIRED RICH BURN COMBUSTOR

[75] Inventor: Glen R. Lazalier, Hillsboro, Tenn.

[73] Assignee: Gas Research Institute, Chicago, Ill.

[21] Appl. No.: 72,723

[22] Filed: Jun. 7, 1993

[51] Int. Cl.[6] ..... F23D 14/46

[52] U.S. Cl. ..... 431/350; 431/8; 431/9; 431/10

[58] Field of Search ..... 431/8, 9, 10, 350, 351, 431/352, 353; 432/13, 37

[56] References Cited

U.S. PATENT DOCUMENTS

| | | | |
|---|---|---|---|
| Re. 33,464 | 11/1990 | Gitman . | |
| 4,622,007 | 11/1986 | Gitman . | |
| 4,642,047 | 2/1987 | Gitman . | |
| 4,654,077 | 3/1987 | Pusateri et al. . | |
| 4,732,368 | 3/1988 | Pusateri et al. . | |
| 4,797,087 | 1/1989 | Gitman . | |
| 4,890,562 | 1/1990 | Gitman . | |
| 4,973,451 | 11/1990 | Vickery | 431/5 X |
| 5,215,075 | 6/1993 | Caridis et al. | 431/5 X |
| 5,310,334 | 5/1994 | Spiros | 431/5 |

FOREIGN PATENT DOCUMENTS

| | | |
|---|---|---|
| 0106712A1 | 4/1984 | European Pat. Off. . |
| 0340424A3 | 11/1989 | European Pat. Off. . |
| 1251162 | 12/1960 | France . |
| 2428622 | 1/1975 | Germany . |

OTHER PUBLICATIONS

European Patent Office, PCT International Search Report, Form PCT/ISA/210 (second sheet) and (patent family annex), Oct. 20, 1994.

*Primary Examiner*—Larry Jones

*Attorney, Agent, or Firm*—Kirkpatrick & Lockhart

[57] ABSTRACT

The invention provides a method and apparatus for creating a stable combustion flame from natural gas and an oxygen containing gas which is useful for the pyrometallurgical treatment of finely divided materials such as metal ores. In particular, natural gas and the oxygen containing gas are injected in a manner which forms recirculation zones between the natural gas and oxygen containing gas thereby maintaining the stability of the combustion flame. The apparatus of the invention encourages the formation of the recirculation zones by using a bluff body orifice plate to provide a dead space between the injections of the oxygen containing gas and natural gas. Additional gas injection is used downstream in the combustor to create turbulence and further stabilize the combustion flame.

16 Claims, 3 Drawing Sheets

NATURAL GAS FIRED RICH BURN COMBUSTOR

BACKGROUND OF THE INVENTION DISCLOSURE

1. Field of the Invention

This invention relates to a combustor which produces hot combustion gases and a stable flame that is useful in combustion processes and may especially be useful in the pyrometallurgical treatment of finely divided materials. More particularly, the invention relates to a combustor which uses a gaseous fuel such as natural gas to produce a stable flame over a wide range of combustion conditions by forming particular flow patterns in the combustor.

2. Description of the Prior Art

The basic chemistry of combustion processes has been known for many years as have simple apparatus for carrying out those processes. Nevertheless, combustion methods and apparatus vary greatly depending on the particular application involved. That variability results from the wide range of fuels, oxygen sources, flowrates, and combustor designs which may be used in a particular application to achieve specific objectives. Consequently, the parameters for a particular combustion application must be developed for that application and are not readily adapted from other different combustion applications. Exemplary of existing combustion apparatus and processes are U.S. Pat. Nos. 4,622,007, 4,797,087 and Re. No. 33,464.

U.S. Pat. Nos. 4,654,077 and 4,732,368 describe a method and apparatus, respectively, for the pyrometallurgical treatment of finely divided materials and are incorporated herein by reference. In particular, those patents describe a method and apparatus which uses a combustion chamber having two co-axially extending, vertical chambers to treat materials such as finely divided metal ores to reduce the metal to a pure form. The combustion gases in those patents expand as they enter the first vertical chamber and then expand again as they enter the second vertical chamber creating toroidal recirculation zones at the annular space next to the chamber walls that help to stabilize the combustion flame. Those patents especially disclose combustion methods and apparatus which use coal or similar solid materials as a fuel. (See col. 9, lines 66–68; col. 10, lines 66–68; col. 12, lines 3–5; and col. 13, lines 10–13.) In addition, those patents disclose that a gaseous fuel such as natural gas may also be used. (See col. 4, lines 36–40.)

A need exists, however, for an improved combustor which uses a gaseous fuel such as natural gas to provide a stable flame over a wide range of conditions.

SUMMARY OF THE INVENTION

The present invention provides a combustor using gaseous fuel which is stable over a wide range of conditions due to particular flow patterns created in the combustor. Moreover, the combustor forms a relatively nonluminous flame under fuel rich conditions (i.e., at oxygen to fuel ratios which are less than stoichiometric). The combustor is applicable to many combustion processes but is especially useful for the pyrometallurgical treatment of finely divided materials such as metal ores.

In broad terms, the combustor comprises: a combustor having primary and secondary combustion chambers defined therein; a means for injecting into the primary combustion chamber a flow of oxygen containing gas as a plurality of gas jets; a means for injecting into the primary combustion chamber a flow of a gaseous fuel at a velocity lower than the oxygen containing gas jets and surrounding the oxygen containing gas jets having a spacing between the oxygen containing gas jets and the flow of gaseous fuel which is effective for forming a recirculation zone around each oxygen containing gas jet; a means for igniting the flows of oxygen containing gas and gaseous fuel to form a flame; and a means for adjusting the flows of the oxygen containing gas and gaseous fuel to maintain the stability of the flame.

Moreover, the combustor may include means for providing additional flows of oxygen containing gas or gaseous fuel into the primary or secondary combustion chambers near the junction between those two chambers for the purpose of creating additional mixing and promoting flame stability.

Preferably, the combustor is configured so that the flows of oxygen containing gas and gaseous fuel expand as they enter the primary combustion chamber whereby a recirculation zone is created next to the inner wall of the primary combustion chamber. Likewise, preferably, the diameter of the secondary combustion chamber is larger than the primary combustion chamber which causes the combustion gases to expand as they flow from the primary to the secondary combustion chambers thereby creating a recirculation zone next to the inner wall of the secondary combustion chamber.

Most preferably, the means for injecting the flow of oxygen containing gas comprises a plurality of tubes connected to a supply of oxygen containing gas which is positioned proximate to the primary combustion chamber. Each tube includes a bluff body orifice plate attached at the end which has a smaller inside diameter than the tube. Consequently, the bluff body orifice plates create a spacing between the oxygen containing gas flow from within the tube and the gaseous fuel flow outside the tube. This spacing between the two flows results in a recirculation of both flows in the form of a double toroidal pattern. In addition, the bluff body orifice plates may include multiple holes through which the oxygen containing gas flows thereby cooling the orifice plate and tube and providing additional turbulence to stabilize the flame in the form of local single toroidal recirculation zone and enhanced shear zones.

DETAILED DESCRIPTION OF THE PREFERRED EMBODIMENTS

The Apparatus of the Present Invention

Figure 1:
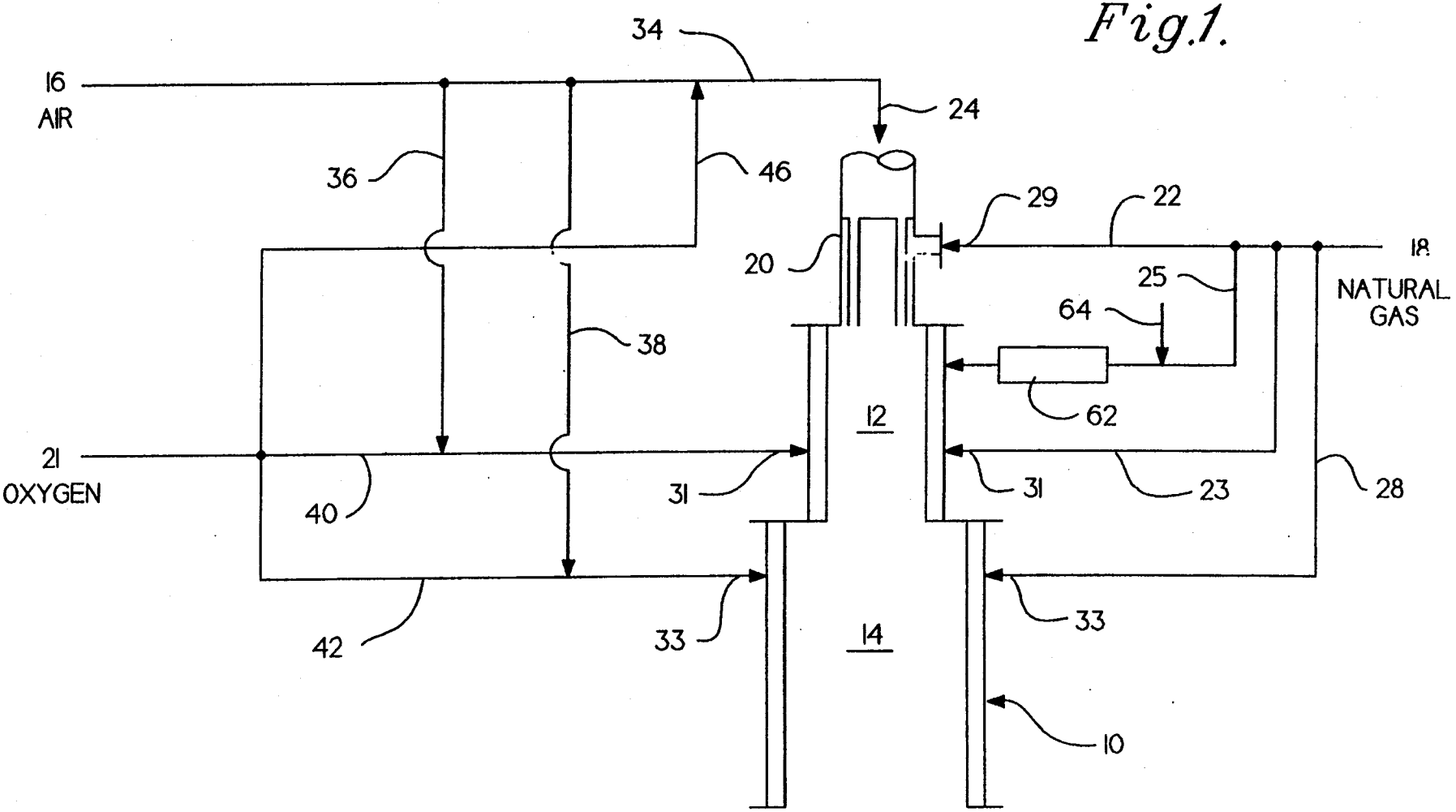
FIG. 1 depicts a schematic diagram of the combustor of the present invention along with its gas supply system.
Figure 2:
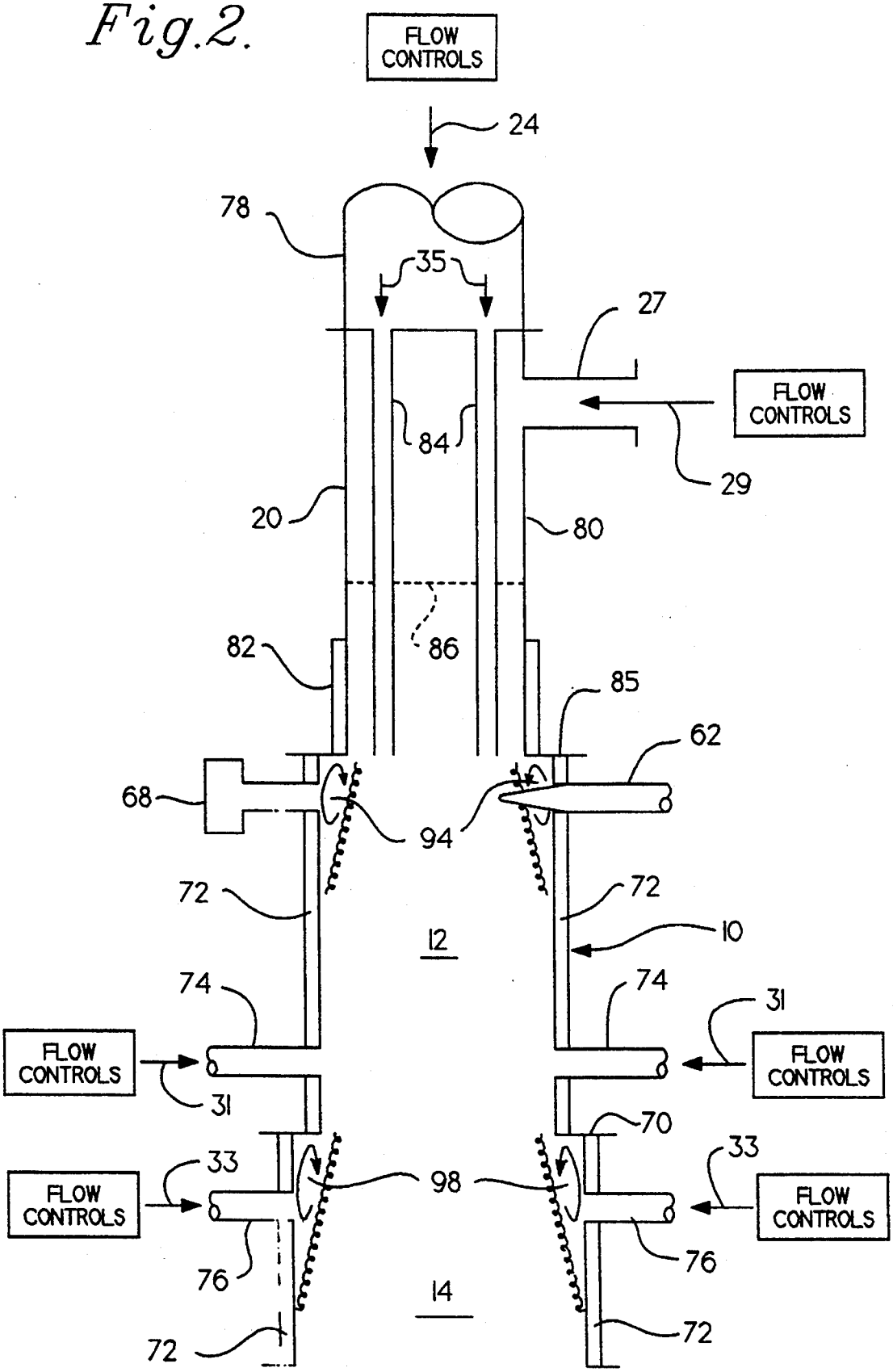
FIG. 2 depicts a cross-sectional view of the combustor of the present invention.

Referring to the drawings, and especially to FIGS. 1 and 2, an apparatus is shown for producing a stable combustion process over a wide range of combustion conditions using natural gas as a fuel. In particular, the apparatus combusts natural gas and an oxygen containing gas such as air mixed with nitrogen at an oxygen to fuel ratio which is less than the stoichiometric ratio.

The apparatus includes a combustor 10 which has a primary combustion chamber 12 and a secondary combustion chamber 14. Attached to combustor 10 is a distribution head 20. An air supply 16, a natural gas supply 18, and an oxygen supply 21 are connected to the distribution head 20.

A fuel gas, preferably natural gas, is supplied to the distribution head 20 of the combustor 10 from the natural gas supply 18 by a tubing run 22. Tubing run 22, as well as all gas lines feeding combustor 10 from their respective gas sources, includes appropriate, conventional measuring and flow control devices (not shown). A second natural gas tubing run 28 optionally delivers natural gas to the secondary combustion chamber 14 of the combustor 10. Similarly, a third natural gas tubing run 23 optionally delivers natural gas to the primary combustion chamber 12 of combustor 10. A fourth natural gas tubing run 25 delivers natural gas to an ignition means 62 which is further described below.

Air is supplied from the air supply 16 to the distribution head 20 of the combustor 10 through a tubing run 34. Air also is supplied through tubing run 36 for optional mixing with oxygen from oxygen supply 21 and subsequent introduction into primary combustion chamber 12. Likewise, air is supplied through tubing run 38 for optional mixing with oxygen from oxygen supply 21 and subsequent introduction into secondary combustion chamber 14. Air also is supplied through a tubing run (not shown) to ignition means 62 as indicated by arrow 64.

Oxygen is supplied from the oxygen supply 21 to the distribution head 20 by a tubing run 46; oxygen thus supplied optionally may be mixed with air in tubing run 34. Oxygen also is supplied through tubing run 40 where it may be optionally mixed with air from tubing run 36 and with natural gas from tubing run 23 for introduction into primary combustion chamber 12. Likewise, oxygen is supplied through tubing run 42 where it may be optionally mixed with air from tubing run 38 and with natural gas from tubing run 28 for introduction into secondary combustion chamber 14.

The results of the various gas supply systems just described are best shown in FIG. 2. Either air or oxygen enriched air may be injected into distribution head 20 as indicated by arrow 24. Natural gas is introduced into distribution head 20 through side port 27 as indicated by arrow 29. Air and/or oxygen and/or natural gas may be introduced into primary combustion chamber 12 through manifold 74 as indicated by arrows 31. Air and/or oxygen and/or natural gas may be introduced into secondary combustion chamber 14 through manifold 76 as indicated by arrows 33.

The apparatus of the present invention includes means 62 for igniting the oxygen containing gas and natural gas to form a flame. Preferably, a conventional natural gas fueled pilot lighter is used to initially ignite the gases when the combustor is first started. The ignition means includes a natural gas supply 25 and an air supply 64, both appropriately controlled. The ignition means 62 is located in the wall of the primary combustion chamber 12 of the combustor 10 proximate to the distribution head 20; see FIG. 2.

The apparatus of the present invention preferably includes means 68 for detecting the presence of a flame in the primary combustion chamber 12. An ultraviolet flame detector has been found to be effective for detecting the presence of a flame in the primary combustion chamber 12. The flame detector 68 is located in the wall of the primary combustion chamber 12 near the distribution head 20 and on the opposite side of the primary combustion chamber from the ignition means 62; see FIG. 2.

Referring to FIG. 2, the combustor 10 and distribution head 20 are shown in more detail. The combustor 10 is generally cylindrical in shape. In particular, the combustor 10 has a primary combustion chamber 12 and a secondary combustion chamber 14 which are differentiated by a flange 70 where a step increase in the diameter of the combustor 10 occurs. Each chamber of combustor 10 preferably has a water cooled jacket 72 for cooling the walls thereof.

As noted above, the primary combustion chamber 12 of the combustor 10 includes an ignition means 62 and a flame detection means 68. Conventional ignition means and flame detection means can be used for these purposes. For example, a natural gas pilot lighter can be used for the ignition means and an ultraviolet flame detector can be used for the flame detection means. The combustor 10 is preferably made from carbon steel.

The combustor 10 includes an injection manifold 74 for injecting oxygen containing gas and/or natural gas into the primary combustion chamber 12 near its junction with the secondary combustion chamber 14. Likewise, the combustor 10 includes an injection manifold 76 for injecting oxygen containing gas and/or natural gas into the secondary combustion chamber 14 near its junction with the primary combustion chamber 12. Preferably, the manifolds 74 and 76 include four radial injection ports spaced equally around the circumference of the combustor 10. The injection ports are oriented at a 90 degree angle from the walls of the combustion chambers 12 and 14. Consequently, the additional gases are injected into the combustor 10 perpendicular to the flow of the combustion gases causing turbulence and increased mixing in the combustion gases.

The apparatus of the present invention further includes a distribution head 20 for introducing natural gas and an oxygen containing gas into the combustor 10. The distribution head 20 is mounted on the combustor 10 atop the primary combustion chamber 12 so that the natural gas and oxygen containing gas are injected into the primary combustion chamber 12. The distribution head 20 includes an upper distribution tube 78 through which the oxygen containing gas flows and a lower distribution tube 80 through which the natural gas flows. Preferably, the lower distribution tube 80 has a water jacket 82 for cooling the tube 80.

The upper distribution tube 78 includes a plurality of tubes 84 which extend into the lower distribution tube 80 and provide means for injecting the oxygen containing gas into the combustor 10. The tubes 84 are the same length as the lower distribution tube 80 but are of considerably lesser diameter. The upper distribution tube 78 preferably includes six tubes 84 which are arranged in a ring around the center axis of lower tube 80.

Preferably the lower distribution tube 80 includes a flow screen 86 which distributes the flow of natural gas throughout the cross sectional area of the tube 80 outside of tubes 84. As a result of this configuration, the flow of natural gas completely surrounds the flow of oxygen containing gas when those gases exit from their respective tubes 84 at the entrance to primary combustion chamber 12. Furthermore, the flows of natural gas and oxygen containing gas are parallel to each other upon their entry to the primary combustion chamber 12. It should be appreciated that the upper distribution tube 78 and attached tubes 84 do not communicate with the lower distribution tube 80, and consequently the oxygen containing gas and natural gas cannot intermix before they are injected into the primary combustion chamber 12.

The primary combustion chamber 12 has a larger diameter than the lower distribution tube 80 and a flange 85 is used to join those two members. This creates a step effect where the natural gas and oxygen containing gas enter the primary combustion chamber 12. Likewise, the secondary combustion chamber 14 has a larger diameter than the primary combustion chamber 12 and a flange 70 is used to join those two members. This too creates a step effect where the combustion gases flow from the primary combustion chamber 12 into the secondary combustion chamber 14.

Figure 3:
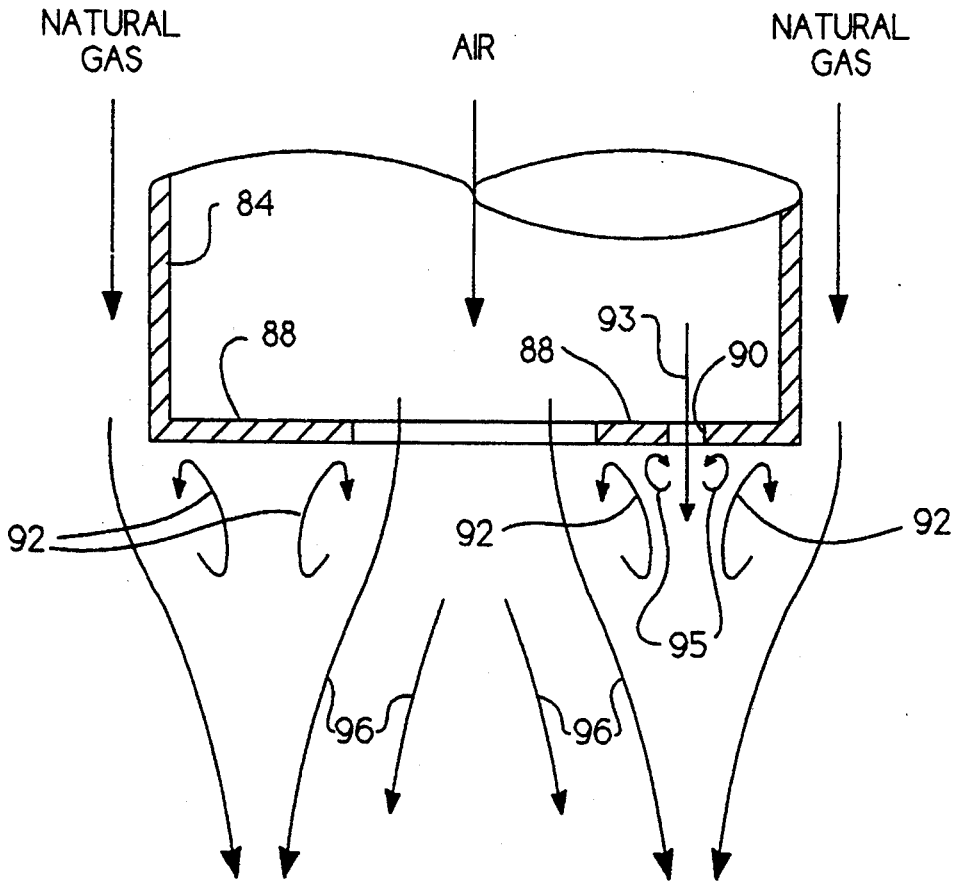
FIG. 3 depicts a cross-sectional view of an end of an oxygen containing gas injection tube for the combustor of the present invention showing the flow patterns created by the oxygen containing gas and gaseous fuel as they enter the primary combustion chamber.

Referring to FIG. 3, which shows the discharge end of a tube 84, preferably each tube 84 includes a bluff body orifice plate 88 attached at the end of the tube 84 where the oxygen containing gas enters the primary combustion chamber 12. The bluff body orifice plate 88 has an inner diameter that is smaller than the inside diameter of the tube 84 and an outer diameter that is the same as the outside diameter of the tube 84. The bluff body orifice plate 88 creates separation between the flows of the oxygen containing gas and the natural gas as they enter the primary combustion chamber 12. The bluff body orifice plate 88 also restricts the flow of the oxygen containing gas to increase its velocity and promote the formation of an oxygen containing gas jet as indicated by arrows 96.

Figure 4:
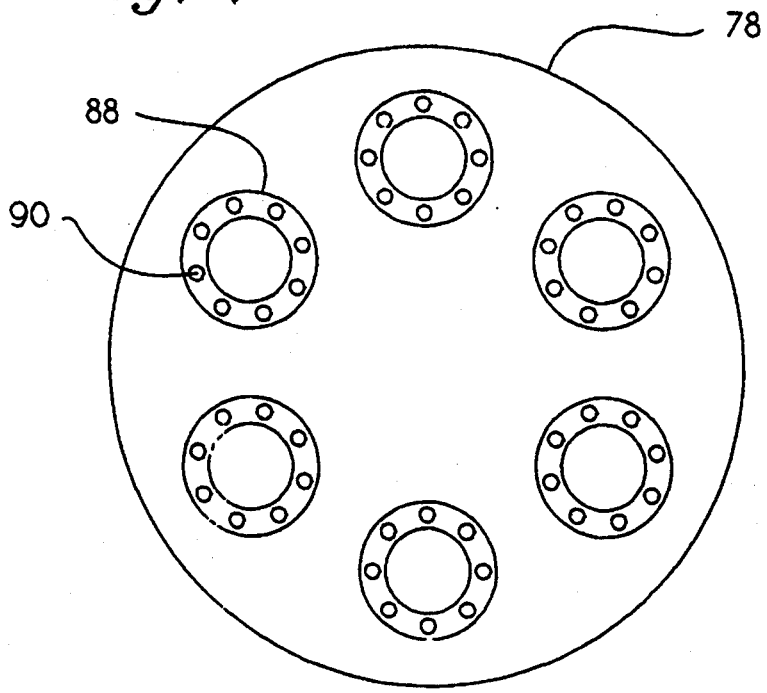
FIG. 4 depicts an end view of the distribution head of the combustor of the present invention showing the oxygen containing gas injection tubes and bluff body orifice plates.

Preferably, the bluff body orifice plate 88 includes small holes 90 (see FIG. 4) which are located in the annular portion of the orifice plate 88 and communicate with the inside of the tubes, 84. The holes 90 are located midway between the inside diameter and the outside diameter of the bluff body orifice plate 88. Oxygen containing gas flows through the holes 90 to provide a cooling effect for the tubes 84 and orifice plate 88 and also creates small jets of oxygen containing gas (see arrow 93 in FIG. 3).

The Operation of the Apparatus of the Present Invention

The operation of the apparatus of the present invention includes the following steps: (1) injecting an oxygen containing gas into the combustion chamber; (2) injecting natural gas into the combustion chamber; and then (3) igniting the oxygen containing gas and natural gas to form a flame. During the operation of the apparatus of the present invention, the oxygen containing gas and natural gas are injected in a particular way to provide flow patterns in the combustor which stabilize the combustion flame even when less than stoichiometric amounts of oxygen are used. Additional natural gas or oxygen containing gas may also be injected into the combustion chamber to further stabilize the flame.

More particularly and with reference to the figures, especially to FIG. 2, an oxygen containing gas is injected into a primary combustion chamber 12 through multiple injection tubes 84 as indicated by the arrows 35. The oxygen containing gas is injected at a velocity ranging from 60 to 400 ft/sec. The high velocity injection of the oxygen containing gas forms parallel jets which extend into the primary combustion chamber 12 in a ring around the center axis of the primary combustion chamber 12. Moreover, those oxygen containing gas jets are located about midway between the center axis and the inner wall of the primary combustion chamber 12. The oxygen containing gas consists of a mixture of oxygen and nitrogen. A mixture of pure air or air mixed with oxygen or pure oxygen is used as the oxygen containing gas. The oxygen content of the oxygen containing gas ranges from 20% for pure air to 100% for pure oxygen. The flow rate of air which is used to make up the oxygen containing gas is controlled by well-known flow measuring and flow control devices. The flow rate of any oxygen which is added to the air to make up the oxygen containing gas also is controlled by well-known flow measuring and flow controlling devices. In this manner the flow rate of the oxygen containing gas and its oxygen content can be carefully controlled.

In the next step of the operation of the apparatus of the present invention, natural gas is injected into the primary combustion chamber 12 through the distribution head 20 via lower distribution tube 80. The natural gas is injected through the cross-sectional area of the distribution head 20 which is not occupied by the oxygen containing gas injection tubes 84. Consequently the natural gas surrounds the oxygen containing gas jets when it enters the primary combustion chamber 12.

The velocity of the natural gas as it enters the primary combustion chamber 12 from lower distribution tube 80 ranges from 15 to 45 ft/sec. That velocity is substantially lower than the velocity of the oxygen containing gas. The lower velocity occurs because the cross-sectional area of lower distribution tube 80 through which the natural gas flows is larger than the cross-sectional area of the tubes 84 through which the oxygen containing gas flows and the volume of the natural gas is less than the oxygen containing gas. Consequently, the natural gas does not form jets as it enters the primary combustion chamber 12. It should be appreciated that because the diameter of the primary combustion chamber 12 is larger than the diameter of the lower distribution tube 80, the natural gas flow into the primary combustion chamber 12 does not attach to the walls of the primary combustion chamber 12 until the gas flow has expanded in volume.

The flow of the natural gas through the lower distribution tube 80 into the primary combustion chamber 12 is controlled by well-known flow measuring and flow controlling devices. With these devices the flow rate of the natural gas can be carefully controlled to any desired amount.

It should be appreciated that other gases could be used instead of natural gas as the fuel in the combustion process of the present invention. For example, gases such as propane, methane, butane or LPG could be substituted for natural gas by those of ordinary skill in the art.

The natural gas and oxygen containing gas are initially ignited by an igniter means 62. The igniter 62 is deactivated once a stable flame has been established. A flame detection device 68 is provided in the primary combustion chamber to determine if a stable flame has been obtained before deactivating the igniter 62.

In addition, the apparatus of the present invention may be operated by injecting additional oxygen containing gas and/or natural gas into the combustor 10 downstream of the distribution head 20 to further stabilize the flame. In particular, referring to FIG. 2, additional oxygen containing gas and/or natural gas may be injected into the primary combustion chamber 12 through manifold 74 near the junction of the primary combustion chamber 12 with the secondary combustion chamber 14. Likewise, additional oxygen containing gas and/or natural gas may be injected into the secondary combustion chamber 14 through manifold 76 near the junction of the secondary combustion chamber 14 with the primary combustion chamber 12. Gas injections through manifolds 74 or 76 are radially inward, perpendicular to the flame, and thus extend into the flame.

Description of Combustor Flow Patterns

The stability of the flame created during the operation of the apparatus of the present invention is largely due to the control of the flow patterns in the combustor 10. Those flow patterns, as illustrated in FIGS. 2 and 3, depend on the geometries of the distribution head 20 and the primary and secondary combustion chambers, 12 and 14, along with the injection velocities of the natural gas and oxygen containing gas. Moreover, additional gas which is injected through manifolds 74 and 76 may further stabilize the flame in the combustor 10.

In particular, the flow pattern in the apparatus of the present invention includes recirculation zones 92, 94, and 98 to stabilize the flame formed in the combustor 10. Recirculation zone 92 is characterized by double toroidal flow which is formed around each of the oxygen containing gas jets. The double toroidal flow results from the bluff body orifice plates 88 which separate and create shear between the flows of the oxygen containing gas and natural gas as they enter the primary combustion chamber 12. Moreover, it is the flow of the oxygen containing gas and natural gas past the dead space created next to each bluff body orifice plate 88 which creates eddy backflow that forms the double toroidal flow. Essentially, the flow of the gas streams past the dead space creates a suction on the dead space. That suction causes gas downstream from the recirculation zone 92 to flow back towards the bluff body orifice plate 88, then deflect perpendicular to the surfaces of the orifice plate 88, and finally to be entrained by the gas flow adjacent to the orifice plate 88.

The size and extent of the recirculation zones 92 depend on the amount of separation between the oxygen containing gas flow and the natural gas flow due to the width of the bluff body orifice plates 88, and also the relative velocities of the oxygen containing gas flow and natural gas flow as they are injected into the primary combustion chamber 12. The recirculation zones 92 promote the rapid convergence and mixing of the oxygen containing gas and natural gas to form a turbulent mixing zone which in turn promotes the stability of the flame.

Preferably, the positive effects of the recirculation zones 92 on the flame stability are enhanced by additional small recirculation zones 95 located inside of the recirculation zones 92 which are created by oxygen containing gas jets 93; see FIG. 3. The oxygen containing gas jets 93 are formed when oxygen containing gas flows through holes 90 in the bluff body orifice plates 88.

Referring again to FIG. 2, recirculation zones 94 and 98 are formed next to the inner walls of the combustor 10. In particular, a recirculation zone 94 is formed next to the inner wall of the primary combustion chamber 12 near the distribution head 20. Like the recirculation zones 92, recirculation zone 94 is created by the flow of the natural gas past the dead space next to the flange 85 which joins the distribution head 20 to the combustor 10. That dead space creates eddy backflow between the inner wall of the primary combustion chamber 12 and the natural gas flow. The recirculation zone 94 is characterized by single major toroidal flow because gas is flowing on only one side of the dead space. Likewise, a recirculation zone 98 is created by the flow of the combustion gases past the dead space next to the flange 70 which joins the primary combustion chamber 12 to the secondary combustion chamber 14. The recirculation zones 94 and 98 help to stabilize the flame by increasing turbulent mixing within the combustor 10. It should be appreciated that the flame formed by the method of the invention may extend out of the secondary combustion chamber 14 and thereby out of the combustor 10. Residual combustion gases flow downwardly and out of secondary combustion chamber 14.

EXAMPLES

Pilot plant testing of the apparatus of the present invention was conducted over a range of combustion conditions. In particular, a test combustor was constructed in accordance with FIG. 2. The primary combustion chamber of the test combustor had an inside diameter of 7 inches, and was 20 inches long. The secondary combustion chamber had an inside diameter of 10 inches, and was 14 inches long. The primary and secondary combustion chambers were constructed of carbon steel with an external water jacket. The primary and secondary combustion chambers were oriented vertically with the primary combustion chamber located above the secondary combustion chamber.

A set of four additional gas injection ports were provided both 3 inches before and 3 inches after the junction between the primary and secondary combustion chambers. Both sets of four ports were spaced equidistantly around the circumference of that combustion chamber, and each set of four ports was manifolded together.

The distribution head had an inside diameter of 5 inches. The distribution head included six tubes ($1\frac{3}{8}$ inch tubing with 0.065 inch wall thickness) equally spaced in a ring with the centers of the tubes located 1.75 inches from the center axis of the distribution head. A bluff body orifice plate was welded to the combustor end of each tube. The orifice plate had an outside diameter of $1\frac{3}{8}$ inches (the same as the tubing) and an inside diameter of $\frac{7}{8}$ inches. Eight equally spaced $\frac{1}{8}$ inch diameter holes were drilled through each bluff body orifice plate midway between the inner and outer diameters.

Tests were conducted with natural gas (primarily methane ($CH_4$)) as the gaseous fuel and mixtures of oxygen ($O_2$) and nitrogen ($N_2$) as the oxygen containing gas. In initial tests the combined oxygen and nitrogen flow was maintained at a constant rate of 466 SCFM, and the oxygen content of the mixture varied from 20 to 50 percent by volume. This resulted in natural gas flow rates which varied from 55 to 167 SCFM with corresponding oxygen/methane ratios of 1.4 to 1.8. The stoichiometric oxygen/methane ratio for combustion is 2.0. Tables 1A, 1B, and 1C, below, show the testing conditions and measured analyses for those initial tests which are designated as test nos. 1 through 20. During the initial tests the oxygen containing gas and natural gas were injected only through the distribution head into the primary combustion chamber and no secondary injection of natural gas, oxygen, or nitrogen was used.

Table 2, below, shows the test conditions and a partial product gas analyses for a set of subsequent test conditions designated as test nos. 21 through 30. The gas analyses for those tests were obtained with a probe located 5 inches from the center axis of the combustor at the exit of the secondary combustion chamber.

Tables 3A and 3B, below, show the test conditions and gas analyses for a set of subsequent test conditions designated as test nos. 31 through 82. In particular, gas samples were taken at a radius of 7 inches from the centerline of the combustor.

Combustor operation was stable over the range of flowrates and oxygen/methane ratios used in the tests. Some instability and noise were experienced when the oxygen content in the oxygen containing gas ranged from 60 to 65 percent by volume, however, the combustion gas compositions did not vary at that oxygen content. The exact reason for cause of these phenomena is not clearly understood.

Heat loss to the combustor walls was close to predicted values, and visual inspection of the inside combustor surfaces showed no visible signs of distress. The six oxygen containing gas injection tubes showed no signs of overheating. A light coating of soot was found on the bluff body orifice plates at the ends of the oxygen containing gas injection tubes, but none was visible anywhere else. Overall, the tests showed that the burner was durable.

TABLE 1A

| | Initial Test Conditions | | | |
|---|---|---|---|---|
| Test No. | $O_2$ (vol %) | $O_2/CH_4$ ratio | $CH_4$ flow (SCFM) | $CH_4$ velocity (ft/sec) |
| 1 | 20 | 1.8 | 52 | 14.3 |

TABLE 1A-continued

| | Initial Test Conditions | | | |
|---|---|---|---|---|
| Test No. | $O_2$ (vol %) | $O_2/CH_4$ ratio | $CH_4$ flow (SCFM) | $CH_4$ velocity (ft/sec) |
| 2 | 20 | 1.7 | 55 | 15.1 |
| 3 | 20 | 1.6 | 58 | 15.9 |
| 4 | 20 | 1.5 | 62 | 17.0 |
| 5 | 20 | 1.4 | 67 | 18.4 |
| 6 | 30 | 1.8 | 78 | 21.4 |
| 7 | 30 | 1.7 | 82 | 22.5 |
| 8 | 30 | 1.6 | 88 | 24.2 |
| 9 | 30 | 1.5 | 93 | 25.6 |
| 10 | 30 | 1.4 | 100 | 27.5 |
| 11 | 40 | 1.8 | 103 | 28.3 |
| 12 | 40 | 1.7 | 109 | 30.0 |
| 13 | 40 | 1.6 | 116 | 31.9 |
| 14 | 40 | 1.5 | 124 | 34.1 |
| 15 | 40 | 1.4 | 133 | 36.6 |
| 16 | 50 | 1.8 | 129 | 35.5 |
| 17 | 50 | 1.7 | 137 | 37.7 |
| 18 | 50 | 1.6 | 146 | 40.1 |
| 19 | 50 | 1.5 | 155 | 42.6 |
| 20 | 50 | 1.4 | 166 | 45.6 |

TABLE 1B

| | Combustion Gas Analysis for Initial Test Conditions | | | | | | | | | |
|---|---|---|---|---|---|---|---|---|---|---|
| Test No. | CO (vol %) | $CO_2$ (vol %) | $O_2$ (vol %) | $N_2$ (vol %) | $H_2$ (vol %) | $H_2O$ (vol %) | H (vol %) | O (vol %) | OH (vol %) | NO (vol %) |
| 1 | .0242 | .0738 | .0000 | .7058 | .0150 | .1810 | .0001 | .0000 | .0001 | .0000 |
| 2 | .0359 | .0662 | .0000 | .6938 | .0254 | .1787 | .0001 | .0000 | .0000 | .0000 |
| 3 | .0472 | .0592 | .0000 | .6808 | .0379 | .1748 | .0001 | .0000 | .0000 | .0000 |
| 4 | .0582 | .0529 | .0000 | .6666 | .0529 | .1693 | .0000 | .0000 | .0000 | .0000 |
| 5 | .0690 | .0473 | .0000 | .6511 | .0705 | .1620 | .0000 | .0000 | .0000 | .0000 |
| 6 | .0377 | .1010 | .0002 | .5824 | .0188 | .2577 | .0007 | .0000 | .0012 | .0003 |
| 7 | .0548 | .0886 | .0000 | .5689 | .0315 | .2547 | .0007 | .0000 | .0007 | .0001 |
| 8 | .0714 | .0770 | .0000 | .5541 | .0473 | .2490 | .0007 | .0000 | .0004 | .0001 |
| 9 | .0871 | .0667 | .0000 | .5382 | .0666 | .2405 | .0006 | .0000 | .0002 | .0000 |
| 10 | .1019 | .0576 | .0000 | .5211 | .0894 | .2293 | .0005 | .0000 | .0001 | .0000 |
| 11 | .0526 | .1217 | .0019 | .4698 | .0241 | .3207 | .0022 | .0003 | .0053 | .0014 |
| 12 | .0724 | .1071 | .0006 | .4572 | .0379 | .3180 | .0025 | .0002 | .0035 | .0007 |
| 13 | .0924 | .0923 | .0002 | .4430 | .0560 | .3110 | .0025 | .0001 | .0023 | .0004 |
| 14 | .1115 | .0786 | .0000 | .4276 | .0784 | .2999 | .0023 | .0000 | .0014 | .0002 |
| 15 | .1292 | .0666 | .0000 | .4111 | .1052 | .2850 | .0020 | .0000 | .0008 | .0001 |
| 16 | .0703 | .1345 | .0060 | .3671 | .0315 | .3696 | .0049 | .0012 | .0120 | .0029 |
| 17 | .0902 | .1202 | .0025 | .3567 | .0453 | .3681 | .0054 | .0007 | .0091 | .0018 |
| 18 | .1116 | .1041 | .0009 | .3447 | .0644 | .3611 | .0056 | .0004 | .0063 | .0010 |
| 19 | .1327 | .0884 | .0003 | .3313 | .0889 | .3485 | .0054 | .0002 | .0040 | .0005 |
| 20 | .1523 | .0741 | .0001 | .3168 | .1186 | .3306 | .0048 | .0001 | .0024 | .0002 |

TABLE 1C

| | Combustion Data for Initial Tents | | |
|---|---|---|---|
| Test No. | Combustor Temperature (°C.) | del $Q_c$ (Btu/lb of total gas flow) | del $Q_r$ (Btu/lb of total gas flow) |
| 1 | 1568 | 28 | 177 |
| 2 | 1537 | 28 | 163 |
| 3 | 1501 | 27 | 149 |
| 4 | 1463 | 26 | 134 |
| 5 | 1419 | 26 | 118 |
| 6 | 1898 | 35 | 362 |
| 7 | 1864 | 34 | 337 |
| 8 | 1827 | 33 | 306 |
| 9 | 1780 | 33 | 277 |
| 10 | 1729 | 32 | 244 |
| 11 | 2107 | 39 | 536 |
| 12 | 2081 | 38 | 506 |
| 13 | 2044 | 38 | 467 |
| 14 | 1998 | 37 | 421 |
| 15 | 1944 | 36 | 373 |
| 16 | 2248 | 41 | 672 |
| 17 | 2231 | 41 | 645 |
| 18 | 2201 | 41 | 602 |
| 19 | 2156 | 40 | 551 |
| 20 | 2101 | 39 | 490 |

TABLE 2

| Subsequent Tests with Gas Probe at 5 inch radius | | | | | | | |
|---|---|---|---|---|---|---|---|
| Test No. | $CH_4$ flow (SCFM) | $O_2$ flow (SCFM) | $N_2$ flow (SCFM) | $O_2/CH_4$ ratio | CO (vol %) | $CO_2$ (vol %) | $O_2$ (vol %) |
| 21 | 55 | 100 | 370 | 1.82 | 1.0 | 8.3 | 21. |
| 22 | 54 | 96 | 326 | 1.78 | 0.0 | 10.6 | 23. |
| 23 | 55 | 92 | 303 | 1.75 | 1.7 | 10.3 | 23. |
| 24 | 65 | 92 | 303 | 1.42 | 1.1 | 10.7 | 23. |
| 25 | 167 | 300 | 530 | 1.80 | 0.0 | 14.0 | 36. |
| 26 | 188 | 300 | 530 | 1.60 | 0.0 | 14.1 | 36. |
| 27 | 214 | 300 | 530 | 1.40 | 0.4 | 21.7 | 36. |
| 28 | 233 | 300 | 532 | 1.29 | 0.2 | 18.2 | 36. |
| 29 | 214 | 300 | 450 | 1.40 | 2.4 | 23.3 | 40. |
| 30 | 214 | 300 | 300 | 1.40 | 1.1 | 20.0 | 50. |

TABLE 3A

| Subsequent Combustion Test Conditions with Gas Probe at 7 Inch Radius | | | | | | |
|---|---|---|---|---|---|---|
| Test No. | $O_2/CH_4$ ratio | $CH_4$ (SCFM) | Burner $O_2$ (SCFM) | Burner $N_2$ (SCFM) | Secondary $O_2$ (SCFM) | Secondary $N_2$ (SCFM) |
| 31 | 1.40 | 114 | 160 | 155 | 0 | 0 |
| 32 | 1.83 | 88 | 161 | 156 | 0 | 0 |
| 33 | 1.42 | 227 | 323 | 53 | 0 | 270 |
| 34 | 1.42 | 227 | 323 | 319 | 0 | 0 |
| 35 | 1.62 | 199 | 323 | 52 | 0 | 270 |
| 36 | 1.81 | 177 | 321 | 0 | 0 | 317 |
| 37 | 1.41 | 148 | 104 | 115 | 105 | 0 |
| 38 | 1.59 | 129 | 102 | 110 | 103 | 0 |
| 39 | 1.84 | 115 | 106 | 110 | 106 | 0 |
| 40 | 1.48 | 295 | 216 | 223 | 220 | 0 |
| 41 | 1.63 | 258 | 354 | 91 | 66 | 130 |
| 42 | 1.68 | 258 | 215 | 225 | 218 | 0 |
| 43 | 1.89 | 230 | 216 | 225 | 218 | 0 |
| 44 | 1.40 | 182 | 255 | 0 | 0 | 65 |
| 45 | 1.39 | 182 | 253 | 64 | 0 | 0 |
| 46 | 1.40 | 182 | 255 | 0 | 0 | 63 |
| 47 | 1.47 | 182 | 267 | 63 | 0 | 0 |
| 48 | 1.58 | 159 | 252 | 64 | 0 | 0 |
| 49 | 1.80 | 141 | 254 | 64 | 0 | 0 |
| 50 | 1.40 | 364 | 303 | 0 | 205 | 128 |
| 51 | 1.63 | 318 | 308 | 0 | 209 | 127 |
| 52 | 1.60 | 318 | 306 | 0 | 204 | 125 |
| 53 | 1.83 | 283 | 308 | 0 | 209 | 127 |
| 54 | 1.84 | 286 | 357 | 52 | 170 | 227 |
| 55 | 1.64 | 322 | 358 | 51 | 171 | 227 |
| 56 | 1.44 | 367 | 358 | 52 | 170 | 227 |
| 57 | 1.40 | 287.3 | 352 | 0 | 64 | 222 |
| 58 | 1.40 | 297.3 | 351 | 36 | 64 | 183 |
| 59 | 1.40 | 296.3 | 350 | 87 | 64 | 135 |
| 60 | 1.39 | 298.8 | 350 | 119 | 64 | 105 |
| 61 | 1.39 | 298.5 | 352 | 150 | 64 | 74 |
| 62 | 1.41 | 295.6 | 353 | 191 | 64 | 27 |
| 63 | 1.43 | 293.5 | 353 | 224 | 66 | 0 |
| 64 | 1.40 | 297.7 | 352 | 188 | 65 | 0 |
| 65 | 1.40 | 296.8 | 352 | 151 | 65 | 0 |
| 66 | 1.39 | 301.5 | 353 | 118 | 65 | 0 |
| 67 | 1.39 | 301.5 | 353 | 85 | 65 | 0 |
| 68 | 1.38 | 301.7 | 352 | 37 | 65 | 0 |
| 69 | 1.38 | 302.0 | 353 | 0 | 65 | 0 |
| 70 | 1.44 | 292.3 | 351 | 0 | 69 | 221 |
| 71 | 1.43 | 293.1 | 350 | 37 | 69 | 183 |
| 72 | 1.42 | 293.4 | 349 | 87 | 69 | 133 |
| 73 | 1.43 | 292.6 | 349 | 116 | 68 | 105 |
| 74 | 1.42 | 292.1 | 348 | 152 | 68 | 74 |
| 75 | 1.42 | 293.2 | 348 | 188 | 68 | 35 |
| 76 | 1.43 | 291.8 | 348 | 226 | 68 | 0 |
| 77 | 1.44 | 288.3 | 348 | 186 | 68 | 0 |
| 78 | 1.42 | 292.1 | 348 | 151 | 68 | 0 |
| 79 | 1.42 | 292.0 | 348 | 117 | 68 | 0 |
| 80 | 1.42 | 293.6 | 349 | 87 | 68 | 0 |
| 81 | 1.43 | 292.0 | 349 | 38 | 68 | 0 |
| 82 | 1.42 | 292.9 | 349 | 0 | 68 | 0 |

TABLE 3B

| Test No. | Subsequent Combustion Test Gas Analyses with Gas Probe at 7 Inch Radius CO (vol %) | $CO_2$ (vol %) | $O_2$ (vol %) | $N_2$ (vol %) | $H_2$ (vol %) |
|---|---|---|---|---|---|
| 31 | 11.1 | 21.7 | 0.1 | 52.0 | 15.1 |
| 32 | 8.7 | 24.3 | 0.0 | 55.8 | 11.0 |
| 33 | 7.6 | 24.6 | 0.2 | 60.8 | 6.8 |
| 34 | 2.7 | 28.6 | 0.2 | 66.3 | 2.2 |
| 35 | 0.1 | 30.2 | 1.3 | 68.3 | 0.1 |
| 36 | 0.0 | 26.6 | 9.4 | 64.0 | 0.0 |
| 37 | 13.8 | 22.8 | 0.3 | 46.9 | 16.3 |
| 38 | 8.1 | 30.8 | 2.1 | 47.9 | 11.1 |
| 39 | 0.5 | 33.4 | 4.7 | 61.0 | 0.3 |
| 40 | 13.7 | 31.7 | 0.1 | 41.8 | 12.7 |
| 41 | 1.4 | 37.0 | 1.9 | 58.7 | 1.0 |
| 42 | 4.3 | 36.2 | 1.8 | 52.7 | 5.0 |
| 43 | 0.1 | 35.7 | 13.2 | 51.0 | 0.0 |
| 44 | 20.6 | 19.4 | 0.3 | 32.9 | 26.8 |
| 45 | 24.6 | 31.3 | 0.2 | 30.6 | 23.3 |
| 46 | 16.1 | 27.3 | 0.4 | 38.1 | 18.1 |
| 47 | 16.6 | 33.7 | 0.3 | 34.5 | 14.9 |
| 48 | 17.9 | 28.3 | 0.3 | 36.3 | 17.3 |
| 49 | 9.8 | 35.2 | 0.5 | 46.4 | 8.1 |
| 50 | 22.7 | 24.0 | 0.2 | 22.8 | 30.4 |
| 51 | 17.6 | 25.2 | 0.0 | 41.0 | 16.3 |
| 52 | 10.3 | 37.0 | 0.3 | 41.7 | 10.6 |
| 53 | 1.3 | 44.1 | 5.6 | 48.2 | 0.9 |
| 54 | 0.0 | 33.1 | 11.9 | 55.1 | 0.0 |
| 55 | 1.9 | 35.6 | 0.7 | 60.7 | 1.3 |
| 56 | 13.1 | 28.8 | 0.2 | 45.2 | 12.8 |
| 57 | 8.8 | 34.2 | 0.2 | 50.1 | 6.8 |
| 58 | 13.8 | 29.7 | 0.2 | 44.2 | 12.1 |
| 59 | 16.5 | 26.1 | 0.2 | 41.6 | 15.6 |
| 60 | 17.8 | 23.7 | 0.2 | 40.0 | 18.2 |
| 61 | 14.4 | 28.2 | 0.2 | 43.7 | 13.5 |
| 62 | 15.6 | 27.2 | 0.2 | 41.4 | 15.6 |
| 63 | 23.9 | 22.0 | 0.1 | 33.9 | 20.0 |
| 64 | 24.1 | 22.9 | 0.1 | 29.6 | 23.4 |
| 65 | 24.1 | 24.0 | 0.1 | 25.6 | 26.1 |

What is claimed is:

1. Combustion apparatus comprising:

a combustor having primary and secondary combustion chambers defined therein;

means for injecting a flow of a first gas which contains oxygen into said primary combustion chamber to form a plurality of gas jets;

means for injecting a flow of a second gas which contains fuel into said primary combustion chamber at a velocity which is less than said first gas jets and wherein said second gas flow encircles each said first gas jet with a spacing between each said first gas jet and said second gas flow which is effective to form a first recirculation zone therebetween;

means for igniting said flows of said first and second gases in said primary combustion chamber to form a stable combustion flame;

means for adjusting said flows of said first and second gases to maintain an oxygen to fuel ratio which is less than stoichiometric; and wherein said primary combustion chamber has a cross-sectional area which is larger than the combined cross-sectional areas of said means for injecting said flows of said first and second gases whereby said flows of said first and second gases expand as they enter said primary combustion chamber to form a second recirculation zone next to a wall of said primary combustion chamber, said secondary combustion chamber has a cross-sectional area which is larger than the cross-sectional area of said primary combustion chamber whereby said combustion gases expand as they enter said secondary combustion chamber to form a third recirculation zone next to a wall of said secondary combustion chamber and said secondary combustion chamber has an opening for exhausting combustion gases and said combustion flame.

2. The apparatus of claim 1 further comprising means for injecting an adjustable flow of a third gas selected from the group consisting of fuel, oxygen, inert gases, or mixtures thereof into said primary combustion chamber proximate to said secondary combustion chamber.

3. The apparatus of claim 2 further comprising means for injecting an adjustable flow of a fourth gas selected from the group consisting of fuel, oxygen, inert gases, or mixtures thereof into said secondary combustion chamber proximate to said primary combustion chamber.

4. The apparatus of claim 1 wherein said plurality of gas jets are oriented in a ring around the center axis of said primary combustion chamber.

5. The apparatus of claim 1 wherein said combustor further; comprises means for cooling walls of said combustor with a fluid.

6. The apparatus of claim 1 further comprising means for detecting a flame in said primary combustion chamber.

7. The apparatus of claim 1 further comprising means for evenly distributing said flow of said second gas within said means for injecting said second gas.

8. The apparatus of claim 1 wherein said means for injecting said flow of said first gas comprises a plurality of tubes connected to a supply of said first gas, said tubes arranged in a ring, each said tube having orifice plate connected at an end thereof whereby said orifice plate provides said spacing between said flows of said first and second gases.

9. The apparatus of claim 8 wherein each said orifice plate includes multiple holes located therein whereby a portion of said flow of said first gas flows through said holes.

10. Combustion apparatus comprising:

a combustor having primary and secondary combustion chambers defined therein, said combustor having fluid cooled walls;

a distribution head connected to said combustor near said primary combustion chamber, said distribution head comprising an outer tube and a plurality of inner tubes, said outer tube connected to a supply of a second gas which contains a fuel and said inner tubes connected to a supply of a first gas which contains oxygen, wherein an adjustable flow of said first gas is injected into said primary combustion chamber through said inner tubes to form a plurality of gas jets and a laminar flow of said second gas is injected into said primary combustion chamber, each said inner tube having an orifice plate connected at an end thereto which is effective to create a spacing between said gas jets and said second gas flow whereby a first recirculation zone is formed therebetween;

means for igniting said flows of said first and second gases in said primary combustion chamber to form a stable combustion flame;

means for adjusting said flows of said first and second gases to maintain an oxygen to fuel ratio which is less than stoichiometric;

wherein said primary combustion chamber has a cross-sectional area which is larger than the combined cross-sectional areas of said outer and inner tubes whereby said flows of said first and second gases expand as they enter said primary combustion chamber to form a second recirculation zone next to a wall of said primary combustion chamber; and wherein said secondary combustion chamber has a cross-sectional area which is larger than the cross-sectional area of said primary combustion chamber whereby said combustion gases expand as they enter said secondary combustion chamber to form a third recirculation zone next to a wall of said secondary combustion chamber.

11. The apparatus of claim 10 further comprising a plurality of ports for injecting an adjustable flow of a third gas selected from the group consisting of fuel, oxygen, inert gases, or mixtures thereof into said primary combustion chamber proximate to said secondary combustion chamber.

12. The apparatus of claim 11 further comprising a plurality of ports for injecting an adjustable flow of a fourth gas selected from the group consisting of fuel, oxygen, inert gases, or mixtures thereof into said secondary combustion chamber proximate to said primary combustion chamber.

13. The apparatus of claim 10 further comprising means for detecting a flame in said primary combustion chamber.

14. The apparatus of claim 10 further comprising means for evenly distributing said flow of said second gas within said outer tube of said distribution head.

15. The apparatus of claim 10 wherein each said orifice plate includes multiple holes located therein whereby a portion of said flow of said first gas flows through said holes.

16. Combustion apparatus comprising:

a combustor having axially aligned primary and second combustion chambers defined therein;

means for injecting a flow of a first gas which contains oxygen into said primary combustion chamber through a plurality of tubes spaced from the central axis of said primary combustion chamber, said tubes each having flow restricting means for causing said first gas to issue as a jet whose diameter is less than said tube;

means for injecting a flow of a second gas which contains fuel into said primary combustion chamber at a velocity less than the velocity of said first gas to surround said jets of said first gas in spaced relationship therefrom, whereby a recirculation zone is formed therebetween;

means for igniting said first and second gases in said primary combustion chamber to form a flame; and means within said second combustion chamber to stabilize said flame.

* * * * *